United States Patent [19]

Ito et al.

[11] 4,410,290

[45] Oct. 18, 1983

[54] COMPOSITE PEN TIP

[75] Inventors: Akio Ito; Osami Yamauchi, both of Nagoya, Japan

[73] Assignee: Pilot Ink Co., Ltd., Aichi, Japan

[21] Appl. No.: 341,727

[22] Filed: Jan. 22, 1982

[30] Foreign Application Priority Data

| | | | |
|---|---|---|---|
| Jan. 27, 1981 | [JP] | Japan | 56-10012[U] |
| Feb. 25, 1981 | [JP] | Japan | 56-25492[U] |
| Feb. 25, 1981 | [JP] | Japan | 56-25493[U] |
| Jul. 22, 1981 | [JP] | Japan | 56-108915[U] |
| Jul. 27, 1981 | [JP] | Japan | 56-111950[U] |
| Aug. 18, 1981 | [JP] | Japan | 56-122215[U] |

[51] Int. Cl.[3] ..... B43K 5/00; B43M 11/06

[52] U.S. Cl. ..... 401/198; 401/199; 401/196; 401/265; 401/292

[58] Field of Search ..... 401/198–199

[56] References Cited

U.S. PATENT DOCUMENTS

| | | | |
|---|---|---|---|
| 3,203,025 | 8/1965 | Schreur | 401/198 X |
| 4,306,819 | 12/1981 | Schusseler | 401/198 |

FOREIGN PATENT DOCUMENTS

| | | | |
|---|---|---|---|
| 1489222 | 7/1967 | France | 401/198 |
| 2052397 | 1/1981 | United Kingdom | 401/198 |

*Primary Examiner*—A. J. Heinz

*Attorney, Agent, or Firm*—Sughrue, Mion, Zinn, Macpeak & Seas

[57] ABSTRACT

A composite pen tip that comprises a core member inserted through a tubular casing to form an axial ink flow channel between the inner surface of the tubular casing and the core member. The core member is made of a material more wear-resistant than the tubular casing and the front ends of the core member and tubular casing are substantially flush with each other to form a level writing face. The tubular casing and the core member are curved in substantially the same form in at least one area in the axial direction and in substantially the same area so that said core member contacts the inner surface of said casing in the location of said curving and frictional contact thereat maintains said core front casing but permits said core to slide backward as said casing wears.

6 Claims, 37 Drawing Figures

COMPOSITE PEN TIP

FIELD OF THE INVENTION

The present invention relates to a composite pen tip. In particular, the invention relates to a composite pen tip adapted for use in a writing tool for fine letters or lines, that comprises a core member inserted through a tubular casing to form an axial flowing channel between the inner surface of the tubular casing and the core member. The core member is made of a material more wear-resistant than the tubular casing with the front ends of the core member and tubular casing being substantially flush with each other to form a level writing face. The tubular casing and the core member are curved in substantially the same manner in at least one area in the axial direction and at substantially the same location so that said core member contacts the inner surface of said casing in the location of said curving and frictional contact thereat maintains said core front end flush with said front end of said casing but permits said core to slide backward as said casing wears.

BACKGROUND OF THE INVENTION

Two types of pen tips adapted for writing tools for writing fine letters or drawing fine lines are known in the art. One is a synthetic resin pen tip having an ink flowing channel of a suitable shape bored through a plastic casing in its axial direction. This type of pen tip is generally used for writing fine letters. The other type is a tubular writing pen tip wherein a weight is attached to the rear end of a core member which is loosely fitted through a fine tubular member. The front end of the core member slightly projects from the writing face so that it can be retracted by the writing pressure. This type of pen tip is generally used for mechanical drawing or drawing fine lines.

The synthetic resin pen tip can be easily produced since the ink flowing channel is formed at the same time as thermoplastic material is shaped into a tubular member by injection molding or extrusion molding. However, such a pen tip can only be made of easily formable materials. Another defect is that a letter or line of a constant width cannot be consistently written. Furthermore, the properties of materials other than thermoplastics which have good adaptability to writing fine letters or lines cannot be effectively utilized. Hence, it has been difficult to produce a hard and rigid wear resistant pen tip or a resilient durable pen tip.

The tubular writing pen tip of the second type can be produced from a hard and rigid material (e.g. metallic material) or combinations of two or more materials, but then, such a pen tip does not meet all requirements for writing fine letters. An acceptable writing pen for fine letters must not only write smoothly at various writing angles but it must also generate a sufficient amount of ink flow out to provide fine letters consistently. The tubular writing pen tip satisfies these requirements when it is used at an angle almost normal to the paper on which the letters are written, but not at other writing angles. A pen tip that satisfies these requirements for various writing angles has not yet to be developed, and accordingly a requirement for an improved pen tip remains for consideration.

German patent application (OLS) No. 3,023,189 discloses a tubular writing pen tip wherein the weight attached to the rear end of the core member is replaced by a sponge or other porous elastic material in contact with the rear end of the core member. The core is allowed to protrude out of the small tube by impact resilience of the sponge. This tip reduces undesirable scratching of the projection of the core member on the writing surface and enables writing with an upwardly facing pen tip. Despite these advantages, the requirements for acceptable consistent writing of fine letters are not met by this pin tip. During writing, the core member vibrates so much that consistent good writing is not achieved. Moreover, the ink flow varies slightly between compression of the porous elastic material and release of the compression, as well as varying between two writing angles. As a result, consistent production of sharp fine letters is not easily accomplished. Additionally, the impact resilience of the porous elastic material is unavoidably decreased with time or because of repeated stresses, and therefore the initial performance of the pen tip cannot be retained.

The core member of the pen tip of German patent application (OLS) No. 3,023,189 functions as an ink guide and provides cleansing effect, but it is not a substantial part of the writing tip during writing, and instead, the front annular end of the tube itself forms a substantial writing tip. This is another reason why good ink flow and smooth writing are not achieved at an angle other than normal to the surface of the paper on which letters are written.

SUMMARY OF THE INVENTION

Therefore, the primary purpose of the present invention is to provide a composite pen tip adapted to write fine letters or drawing fine lines that uses the composite effect of combinations of various materials that suit the specific purpose.

It is another object of this invention to define the composite pen tip where the core member, combined with the tubular casing, is allowed to work consistently as the substantial part of the writing tip to achieve smooth consistent writing of fine letters or lines of a constant width with a proper ink flow.

These objects of the present invention are achieved by a composite pen tip that comprises a core member inserted through a tubular casing to form an axial ink flowing channel between the inner surface of the tubular casing and the core member. The core member is made of a material more wear resistant than the tubular casing and the front ends of the core member and tubular casing are substantially flush with each other to form a level writing face. The tubular casing and the core member are curved in substantially the same form in at least one area in the axial direction and in substantially the same portion so that the core member can slide backward as the tubular casing wears.

DETAILED DESCRIPTION OF THE INVENTION

Figure 1:
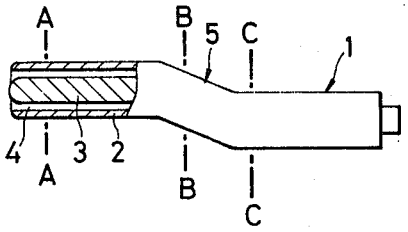
FIG. 1 is a partial longitudinal section of a composite pen tip according to a first embodiment of the present invention.

In the accompanying drawings, a core member 3 functions as the substantial part of a writing tip and plays an important role in achieving consistent and smooth writing of fine letters. A tubular casing 2 serves as the shell of the pen tip and reinforces the core member 3 and its inner surface forms an axial ink flowing channel 4 with the core member 3. The core member 3 is inserted in the tubular casing 2 and the front ends of the two elements are arranged nearly flush with each other to form a level writing face in such a manner that the tubular casing 2 serves as part of the writing tip. The core member 3 does not project from the writing tip but instead is nearly flush with the front end of the tubular casing 2. Hence, the core will not deform or break irrespective of the writing angle or pressure and it has sufficient durability for use in writing fine letters or lines. Importantly, the pen tip achieves consistent smooth writing without vibration or unpleasant sound associated with scratching of the casing 2. The pen tip of this construction allows the use of a less durable material in the tubular casing 2 since the core member 3 significantly reduces the wearing of the casing 2.

Another feature of the present invention is that the pen tip having the above described arrangement is curved at least at one area in its axial direction so that the core member 3 is slidable backwardly as the tubular casing 2 wears. The advantage of this construction is that the core is maintained in a flush arrangement so that the writing tip remains level to achieve smooth writing of fine letters and lines with a consistent ink flow. More specifically, both the tubular casing and core member are curved in substantially the same form in substantially the same area in the axial direction. For a given axial stress, the core member is brought into contact with the inner surface of the tubular casing in the curved area 5 and the resulting limited frictional resistance permits the core member to slide backward.

The sliding properties of the core member are related to the force by which the tubular casing holds the core member in position. A force that causes the core member to slide back in the axial direction is a compression load of about 10 to 250 g, preferably from 30 to 180 g, is suitable for practical purposes. If the sliding force is smaller than the lower limit of the range, the core member becomes freely movable and consistent writing is not secured. Also, the wear or deformation of the tubular casing is accelerated to cause uneven ink flow. If the sliding force is greater than the upper limit, the core member will not slide back smoothly as the tip of the tubular casing wears under writing pressures in the range of practical utilization. In consequence, the core member projects from the tubular casing and causes tip deformation, breakage or other trouble that make consistent smooth writing of fine letters with a controlled ink flow difficult.

To minimize the adverse effect on the ink flow and maximize the sliding of the core member, the curved area 5 is a relatively gentle curve of shallow slope.

Combinations of these curves may also be used. As described above, the core member 3 is forced into contact with the inner surface of the tubular casing in the curved area 5, so that not only the shape of the curved area 5 but also the shape of the core member and the inner shape of the tubular casing have an effect on the sliding of the core member and ink flow. To achieve smooth sliding of the core member and good ink flow, it is desirable that the core member be positioned as close as possible to the center of the tubular casing and the area of contact between the core member and the tubular casing be held to the minimum necessary degree. To satisfy these requirements, the inner surface of the tubular casing has a different cross section than the core member, or a plurality of projections are axially formed on the outer surface of the core member and/or the inner surface of the tubular casing.

Figure 18:
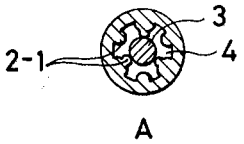
FIG. 18 is a cross section taken on the line A—A of FIG. 17.

The tubular casing and core member used in the present invention will now be described. The tubular casing 2 is generally made of a thermoplastic resin such as polyacetal, polyamide, polyimide, polybutylene terephthalate, methacrylic resin, nonyl resin, polyvinylidene fluoride and polyolefin resins, a blend of these thermoplastic resins with a lubricant and other fillers; ceramics, metals such as stainless steel, brass, nickel silver and super hard alloys; and other ink-resistant materials. The cross section of the interior of the tubular casing may be circular, polygonal or other various forms. Projections such as elements 2-1 in FIG. 18 are advantageously formed axially on the inner surface of the tubular casing.

The core member 3 must at least be made of a material more wear-resistant than the tubular material. More specifically, it is generally made of any of the synthetic resins mentioned above matched to achieve this difference in wear characteristics; composite reinforced plastic materials; inorganic materials such as glass; ceramics; metals such as stainless steel, brass, nickel silver and super hard alloys; and other ink-resistant materials. The core member generally has a diameter of from 0.05 to 0.9 mm. The cross section of the core member is circular, polygonal or other various forms. Axial projections may be formed around the core member.

Figure 2:
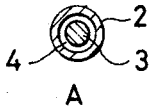
FIGS. 2 to 4 are cross sections taken on the lines A—A, B—B and C—C, respectively, of FIG. 1.
Figure 3:
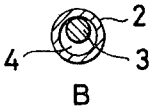
Figure 4:
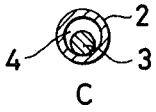
Figure 5:
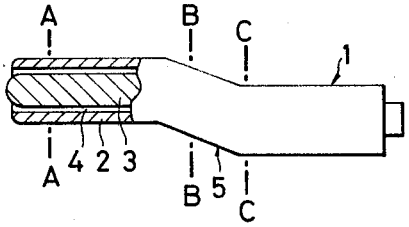
FIG. 5 is a partial longitudinal section of a composite pen tip according to a second embodiment of the present invention.

Specific embodiments of the present invention are now described by reference to the accompanying drawings. FIGS. 1 to 4 show a composite pen tip according to the first embodiment of the present invention. A stainless steel core member 3 (0.25 mm in diameter) is loosely fitted through a tubular casing of polyacetal resin 2 (OD: 0.60 mm, wall thickness: 0.1 mm). An axial flowing channel 4 is formed between the inner surface of the tubular casing and the core member, and the front ends of both the core member 3 and the tubular casing 2 are arranged substantially flush with each other to form a level writing tip. The tubular casing 2 has a curved area 5 in to which the internal core member 3 is curved in substantially the same form. Because of this arrangement, the core member is allowed to slide back as a result of frictional resistance that develops against the backward stress that is applied to the core member when the front end of the tubular casing wears. To provide smooth writing, the other periphery of the front end of the tubular casing is chamfered whereas the front end of the core member is provided with a curved surface. FIGS. 2–4 show various cross sections of the core and casing to illustrate the contact between those elements in the curved Area 5.

Figure 6:
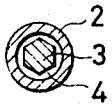
FIGS. 6 to 8 are cross sections taken on lines A—A, B—B and C—C, respectively, of FIG. 5.
Figure 7:
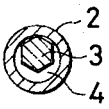
Figure 8:
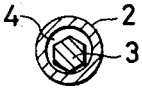
Figure 9:
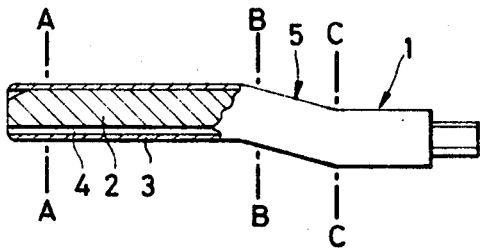
FIG. 9 is a partial longitudinal section of a composite pen tip according to a third embodiment of the present invention.

FIGS. 5 to 8 show a composite pen tip according to the second embodiment of the present invention wherein the interior of the tubular casing has a different cross section, a circle, than the core member which is a hexagon. A polyamide core member 3 having a regular hexagonal cross section (distance between opposite apexes: 0.25 mm) is loosely fitted through a polyacetal tubular casing 2 (OD: 0.6 mm; wall thickness: 0.1 mm). An axial ink flowing channel 4 is formed between the inner surface of the tubular casing and the core member and the front ends of both the core member 3 and tubular casing 2 are arranged substantially flush with each other to form a level writing tip. Both the tubular casing 2 and internal core member 3 are curved in an area 5 in substantially the same manner. On one end of the curved area 5, the core member 3 contacts the inner surface of the tubular casing 2 at one apex of the hexagon as shown in FIG. 7, and on the other end of the curved area the core member contacts the tubular casing at the opposite apex of the hexagon (FIG. 8). By this arrangement, the core member is allowed to slide back as a result of frictional resistance that develops against the backward stress applied to the core member when the front end of the tubular casing wears. The axial ink flowing channel 4 is formed at least between the core member 3 and the inner surface of the tubular casing 2 except for the area of contact between an apex of the hexagon and the tubular casing. FIG. 6 illustrates the axially concentric orientation in the straight region of the pen tip near the front end.

Figure 10:
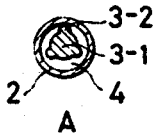
FIGS. 10 to 12 are cross sections taken on the lines A—A, B—B and C—C, respectively, of FIG. 9.
Figure 11:
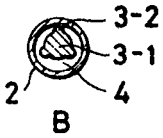
Figure 12:
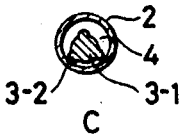
Figure 13:
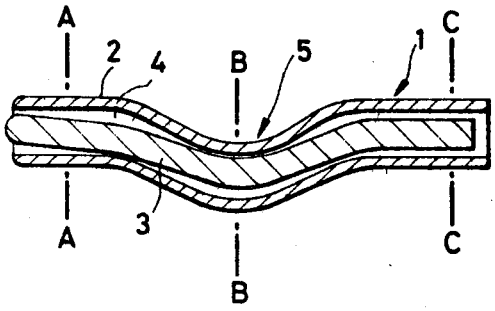
FIG. 13 is a longitudinal section of a composite pen tip according to a fourth embodiment of the present invention.
Figure 14:
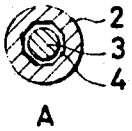
FIGS. 14 to 16 are cross sections taken on the lines A—A, B—B and C—C, respectively, of FIG. 13.

FIGS. 9 to 12 show a composite pen tip according to the third embodiment of the present invention. A polyamide core member 3 comprising a center core 3-1 (0.19 mm in diameter) formed integral with three projections 3-2 is loosely fitted through a polyacetal tubular casing 2 (OD: 0.6 mm; wall thickness: 0.1 mm). The front ends of the core member 3 and the tubular casing 2 are arranged substantially flush with each other to form a level writing tip. Both the tubular casing 2 and internal core member 3 are curved in the area 5, and the core member 3 is off center in different positions in the axial direction as shown in FIGS. 10 to 12. At least one projection 3-2 on the core member is in contact with the inner surface of the tubular casing 2. An axial ink flowing channel is formed between the inner surface of the tubular casing 2 and the core member 3 except for the area of contact between a projecton 3-2 and the inner wall of the tubular casing.

Figure 15:
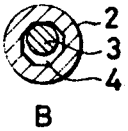
Figure 16:
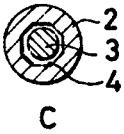

FIGS. 13 to 16 show a composite pen tip according to the fourth embodiment of the present invention. This is the converse of the second embodiment shown in FIG. 5 using an octagon shape for the interior wall of the casing. A tubular casing 2 made of a metal tube having an outside diameter of 0.80 mm and a regular octagonal interior having a wall thickness of 0.13 mm as measured between the outer periphery and an apex of the octagon is curved in the axial direction as shown, and a stainless steel core member 3 curved in substantially the same form (0.20 mm in diameter) is fitted through the tubular casing 2. As shown in FIG. 15, an axial ink flowing channel 4 is ensured between the core member and the tubular casing even in the curved area 5.

Figure 17:
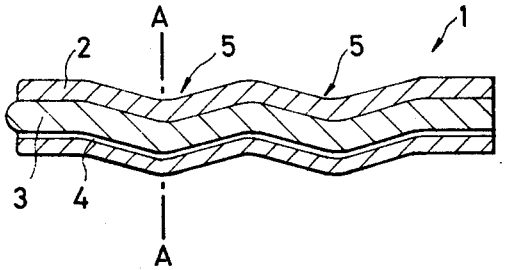
FIG. 17 is a longitudinal section of a composite pen tip according to a fifth embodiment of the present invention.

FIGS. 17 and 18 show a composite pen tip according to the fifth embodiment of the present invention. A tubular casing 2 is extrusion-molded from polyacetal resin. It has an outside diameter of 0.60 mm and has six axial projections 2-1 formed on the inner surface. Three of these projections are higher than the others, that is project inward closer to the center, and support a stainless steel core member 3 (0.15 mm in diameter) which is fitted through the tubular casing 2. The other three smaller projections modify the shape and size of the ink flowing channel 4 and at the same time, they increase the durability of the pen tip and achieve smoother writing. The projections alternate in size on the inner wall of the casing. The serpentine curved area 5 increases the frictional resistance of the core member and controls its backward sliding.

Figure 19:
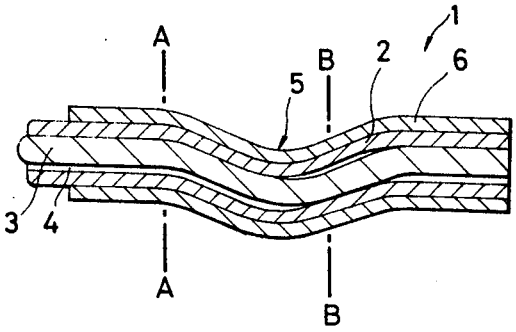
FIG. 19 is a longitudinal section of a composite pen tip according to a sixth embodiment of the present invention.
Figure 20:
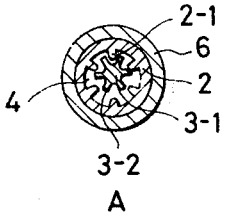
FIGS. 20 and 21 are cross sections taken on the lines A—A and B—B, respectively, of FIG. 19.
Figure 21:
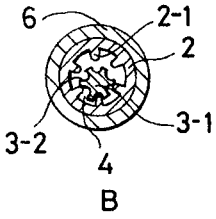

FIGS. 19 to 21 show a composite pen tip according to the sixth embodiment of the present invention. A rigid core member 3 comprising a center core 3-1 (0.15 mm in diameter) is formed integrally with six axial outward surrounding projections 3-2. It is fitted loosely through a polyamide tubular casing 2 (OD: 0.80 mm, wall thickness: 0.20 mm) having six axial inward projections 2-1 formed on the inner surface. An axial ink flowing channel 4 is formed between the inner surface of the tubular casing and the core member and both elements are curved axially as shown at region 5 to provide sliding force against the axial stress applied to the core member. The projections 2-1 and 3-1 are staggered relative to each other.

The pen tip 1 can be given a curved shape as shown, by slipping a metal tube over the tubular casing 2 through which the core member 3 has been fitted and then by bending the tube into the desired shape. The metal tube can be directly used as a retainer 6 for the curved area 5. The retainer not only retains the curved shape of the pen tip 1 but it can also be used as a pen tip holder that achieves easy mounting of the pen tip 1 onto the tubular neck of a writing tool.

Figure 22:
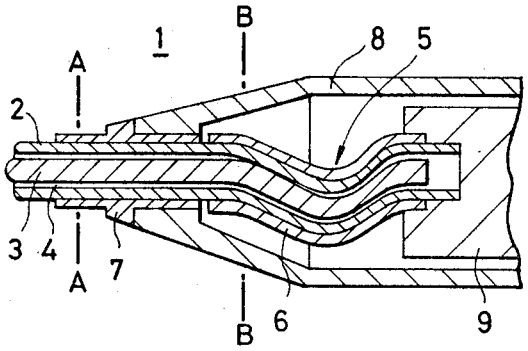
FIG. 22 is a longitudinal section of a composite pen tip as mounted in a pen holder in accordance with a first pen holder embodiment of the present invention.
Figure 23:
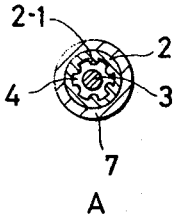
FIGS. 23 and 24 are cross sections taken on the lines A—A and B—B, respectively, of FIG. 22.
Figure 24:
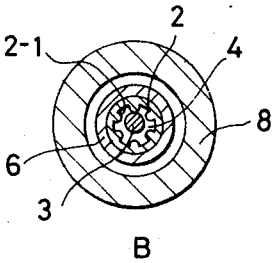

FIGS. 22 to 24 are longitudinal sections of a composite pen tip mounted in the tubular neck of a writing tool in one writing instrument embodiment of the present invention. In FIG. 22, the composite pen tip 1 comprises a polyacetal tubular casing 2 (OD: 0.80 mm, wall thickness: 0.1 mm) having six inward axial projections 2-1 formed on the inner surface. A stainless steel core member 3 (0.23 mm in diameter) is fitted through said tubular casing to form an axial ink flowing channel 4.

The front ends of the core member and tubular casing are arranged substantially flush with each other to form a level writing tip. A pen tip holder 7 holds the outer periphery of the tubular casing 2 in position and is mounted on the front part of the pen tip 1. A curved area retainer 6 for retaining the curved area 5 is mounted on the rear part of the pen tip. The pen tip 1 with the holder 7 and retainer 6 is fitted into a tubular neck 8 of the writing tool. The holder 7 is made of a rigid material such as a metal; it is slipped over the pen tip and pressed or otherwise deformed by a punch or other pressing means to hold the tubular casing 2 in position. The rear end of the composite pen tip 1 is connected to an ink supply 9 made of a bundle of fibers or an ink holder having a comb groove mechanism. They are connected either directly or through an ink guide core, not shown.

Figure 25:
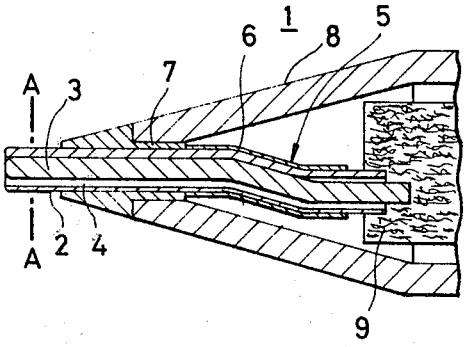
FIG. 25 is a longitudinal section of a composite pen tip as mounted in a pen holder in a second pen holder embodiment of the present invention.
Figure 26:
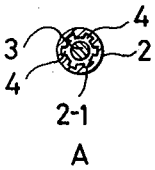
FIG. 26 is a cross section taken on the line A—A of FIG. 25.
Figure 27:
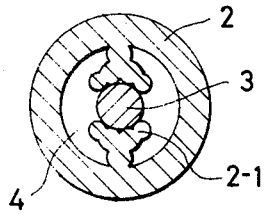
FIGS. 27 to 37 are cross sections showing other combinations of the core member and tubular casing used in the pen tip of the present invention.
Figure 28:
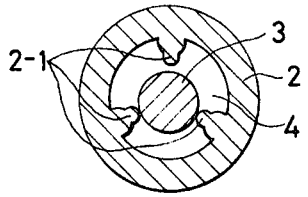
Figure 29:
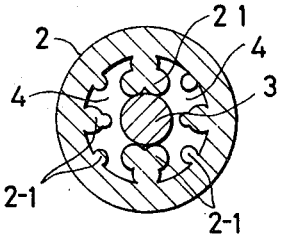
Figure 30:
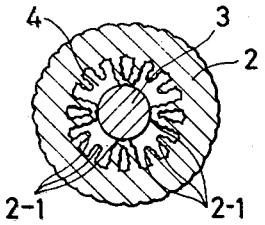
Figure 31:
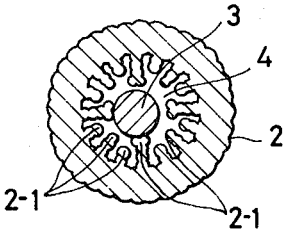
Figure 32:
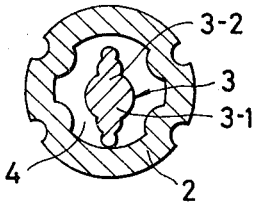
Figure 33:
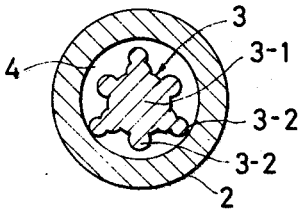
Figure 34:
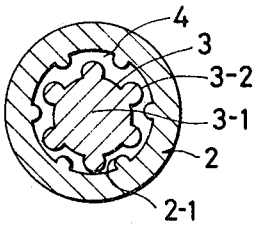
Figure 35:
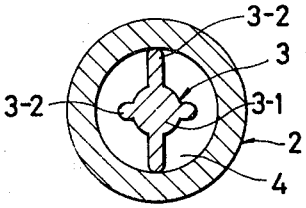
Figure 36:
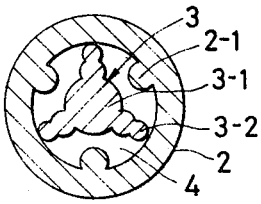
Figure 37:
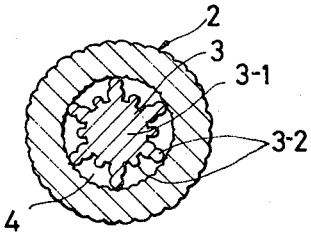

In FIG. 25, a second writing instrument embodiment is shown. The core member 3 and tubular casing 2 are the same as used in FIG. 22 and they are curved in an area 5 as shown. A pen tip holder 7 and a curved area retainer 6 which are the same as used in FIG. 22 are mounted on the pen tip which is then fitted into the tubular neck 8 of a writing tool. In FIGS. 22 and 25, the pen tip holder 7 may be integral with the curved area retainer 6 rather than being separate from each other. It is also to be noted that in the foregoing six embodiments of FIGS. 1–21 where the core member is loosely fitted through the tubular casing, the core member may oscillate slightly to provide various cross sections when taken on the line A—A.

Cross sections of other combinations of the core member and tubular casing that can be used in the composite pen tip of the present invention are shown in FIGS. 27 to 37. FIGS. 27–31 show embodiments where two or more axial projections 2-1 are formed on the inner surface of the tubular casing 2 and the core member 3 is supported by at least two of such projections. In FIGS. 28–31 the remaining projections do not extend radially inward to contact the core.

FIGS. 32 to 37 are embodiments wherein the core member 3 comprises a center core 3-1 that has at least two projections 3-2 formed around it. The projections 2-1 and 3-2 occupy a relatively small space and are narrow. Their purpose is to position the core member 3 in the center of the tubular casing 2, that is to prevent the core member from becoming off center and to provide the proper groove width, size and shape of the ink flowing channel depending on the specific object to achieve optimum ink flow, great durability and smooth writing.

What is claimed is:

1. A composite pen tip comprising: a hollow tubular casing; a core member slidably inserted in said tubular casing to form an axial ink flowing channel between the inner surface of the tubular casing and the outer surface of the core member, said core member being made of a material more wear-resistant than the tubular casing; a plurality of axially extending projections protruding inwardly into said ink flowing channel from the inner surface of the tubular casing; said tubular casing and core member axially terminating at respective front ends which are substantially flush with each other to form a level writing face, and the tubular casing and the core member being bent along the axial direction thereof in substantially the same manner in at least one location in substantially the same place whereby said core member contacts said projections in the location of said curving so that blocking of said ink flowing channels and reduction of the cross-sectional area of said channels is eliminated and frictional contact thereat maintains said core front end flush with said front end of said casing but permits said core to slide backward as said casing wears.

2. The composite pen tip of claim 1 wherein said core outer surface is circular.

3. The composite pen tip of claim 1 wherein said projections define points of contact between said core and said casing at said bent location whereby frictional contact maintains said core front end flush with said front end of said casing but permits said core to move backward when said casing wears.

4. The composite pen tip of claim 1 further comprising additional projections alternating with said axial projections that define points of contact, said additional projections being radially shorter than said point contact defining projections.

5. The composite pen tip of claim 1 further comprising a pen tip holder engaging the outer periphery of said casing and a retainer for holding said casing at its bent location.

6. The composite pen tip of claim 5 wherein said pen tip holder and said retainer are integral elements.

* * * * *